United States Patent [19]

Bezsilko

[11] 4,004,598

[45] Jan. 25, 1977

[54] MACHINE FOR SEPARATING PIECES OF MONEY OR SIMILAR ARTICLES

[75] Inventor: Nicolas Bezsilko, Tourcoing, France

[73] Assignee: S.A. Vandeputte Fils a Cie (department electronique Velec Sefat), Tourcoing, France

[22] Filed: Oct. 15, 1975

[21] Appl. No.: 622,603

[30] Foreign Application Priority Data

Oct. 15, 1974 France ..... 74.35052

[52] U.S. Cl. ..... 133/1 R; 133/3 H; 133/8 R

[51] Int. Cl.[2] ..... G07D 3/00; G07D 9/00

[58] Field of Search ..... 133/8 R, 8 A, 8 C, 3 R, 133/3 A, 3 H

[56] References Cited

UNITED STATES PATENTS

| | | | |
|---|---|---|---|
| 3,253,604 | 5/1966 | Read | 133/8 R |
| 3,376,970 | 4/1968 | Roseberg | 133/8 R |

*Primary Examiner*—Allen N. Knowles

*Attorney, Agent, or Firm*—Cameron, Kerkam, Sutton, Stowell & Stowell

[57] ABSTRACT

A machine for handling pieces of money or similar articles has a fixed wall on which the pieces roll and the wall is extended by a rolling band extending over the circular path followed by the pieces to reduce the effective width of the path so that only a single piece can be supported by the path and other non-supported pieces fall by their weight into a central zone. The machine efficiently separates pieces the smallest of which have a diameter equal to one-half the diameter of the largest pieces.

5 Claims, 2 Drawing Figures

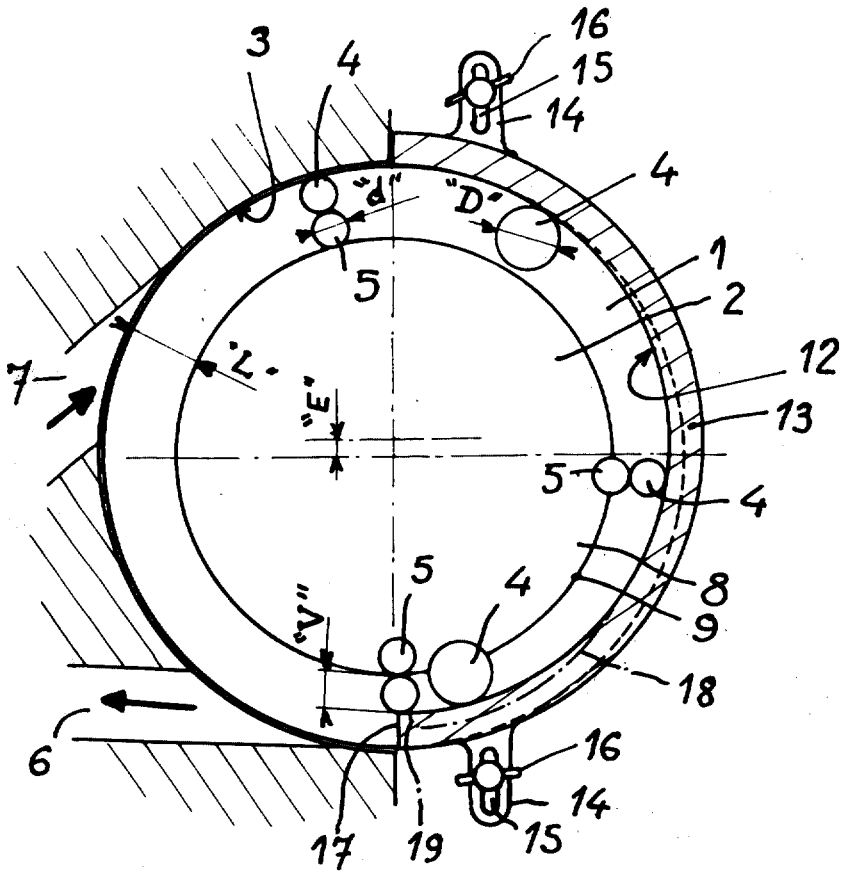
Fig. 1
Fig. 2
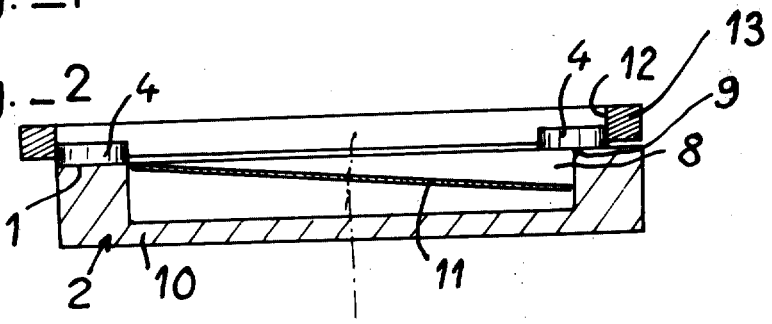

MACHINE FOR SEPARATING PIECES OF MONEY OR SIMILAR ARTICLES

BACKGROUND OF THE INVENTION

The present invention relates to a machine for the separation and/or counting of pieces of money or similar articles.

To separate and/or count pieces one of the essential operations for correctness of result consists in placing the pieces one behind the other so that a single piece at a time is presented to subsequent work stations.

To this end it is known to utilize a circular path supported by a plate or a hollow rotating vessel and surrounded at least locally by a fixed cylindrical wall on which roll and bear by centrifugal force the edges of the pieces fed to the path by any known means.

An opening in the fixed wall provides an exit by which the pieces, subject to centrifugal force, are ejected in the direction of subsequent work stations.

In such apparatus used alone errors in counting can occur when at least one piece has a diameter of or a thickness at least equal to one half of the corresponding dimension of the largest piece since then the exit can pass two small pieces circulating side by side or one on the other.

Numerous means are known to separate pieces located above pieces resting directly on the circular path before reaching the exit. For example, certain constructions utilize to this end rotating brushes and/or rollers of flexible material to cause the rejection of such pieces into a central zone defined by the internal surface of the path before reaching the exit.

Other very efficient apparatus had been described by the present applicant. This construction comprises on the element bordering the circular path a zone bearing on the pieces resting directly on the circular path which has a different profile from that of a bearing zone for the pieces located at an upper level just upstream of the exit with the last zone providing a ramp on which the pieces in this zone are projected into the central zone thus preventing passage through the exit.

Heretofore there has been no means known to efficiently separate pieces circulating side by side before they reach the exit from the device. The present invention therefore provides a separating and/or counting machine for pieces of money and similar articles which assures separation of pieces circulating side by side to eliminate this source of error.

BRIEF DESCRIPTION OF THE INVENTION

The present invention has for its object to provide a machine of the above-mentioned type in which, adjacent the exit, the circular path is narrowed with respect to a central zone defined by the internal wall of the path and in which locally the fixed wall on which the edges of the pieces roll has the form of an eccentric band with respect to the circular path to reduce the width of the circular path so that only one piece is stably supported by the path and the other pieces by reason of their weight fall into the central zone.

BRIEF DESCRIPTION OF THE DRAWINGS

A preferred embodiment of the present invention will now be described with respect to the accompanying drawings in which FIG. 1 is a view from above of the circular path; and FIG. 2 is a vertical sectional view of the embodiment of FIG. 1 through the axis of rotation of the path.

DESCRIPTION OF THE PREFERRED EMBODIMENT

The machine of the present invention has a circular path 1 supported by a hollow vessel 2 rotated by any suitable means.

Path 1 is partially enclosed by a fixed wall 3 on which roll by centrifugal force the edges of pieces 4.

The object of the present invention is to withdraw from the path pieces 5 circulating beside pieces 4 to prevent them from passing through exit 6 formed by a break in wall 3.

Pieces 4 and 5 are fed to path 1 by any suitable means including an entrance 7.

Path 1 is elevated with respect to central zone 8 defined by its internal surface 9.

This central zone is formed by bottom 10 of vessel 2 and may include means for recovering and/or recycling pieces which fall from path 1 including an inclined surface 11.

In accordance with the essential characteristic of the present invention, locally the cylindrical fixed wall 3 is extended by a band 12 which is eccentric with respect to path 1 to progressively reduce the normal width L to a value V less than 1 ½ times the diameter d of the smallest piece to be separated but at least equal to one-half of the diameter D of the largest piece to be separated.

By reason of this construction, adjacent exit 6, only a single piece can be stably supported by the path while the other pieces fall by their weight into central zone 8.

The minimum dimension of the path can be fixed at one-half of the diameter of the largest piece. If static this would produce an unstable equilibrium of the piece but in the machine centrifugal force acts to stabilize this equilibrium.

In the preferred embodiment of the present invention band 12 is formed by the portion of a curve 13 eccentric with respect to the axis of rotation of path 1.

The eccentricity E can advantageously be adjusted as a function of the diameters of the smallest and of the largest pieces to be separated to within the range of adjustment discussed above. To this end, the position of curve 13 provided with securing ears 14 having oblong openings 15 to receive nuts and bolts 16 for adjustment to the desired position.

Without interfering with the function of the band 12, its extremity 17 can include for pieces located above those directly resting on the circular path a second bearing zone 18 terminated by a ramp 19 as described in the French patent referred to above. This provides at a single position all of the separations required for pieces superimposed with respect to each other as well as those circulating side by side.

What I claim is:

1. A machine for handling pieces of money or similar items comprising a circular rotating path, a hollow vessel supporting said path for rotation, a fixed wall partially surrounding said path, an opening in said wall for supplying the pieces to be separated to the rotating path whereby the edges of the pieces roll along the wall under centrifugal force, an exit opening in the wall through which the pieces are discharged by centrifugal force to subsequent work positions, a band extending said wall adjacent said exit, means for adjusting the position of said band with respect to said path adjacent said exit, said band extending over said path and reducing the width of said path to support a single piece at said exit, the other pieces falling by their weight into said central zone.

2. A machine as described in claim 1, said circular path upstream of said exit having a reduced width less than 1 ½ times the diameter of the smallest piece and at least equal to one-half the diameter of the largest piece to be separated.

3. A machine as described in claim 1, said band being a portion of a curve eccentric with respect to the axis of rotation of said path.

4. A machine as described in claim 3 including means for varying the eccentricity of said band as a function of the diameter of the pieces to be separated.

5. A machine as described in claim 1, an extremity of said band located immediately upstream of said exit including a second zone engaged by pieces above pieces located on the circular path and a ramp for said last named zone moving the pieces not directly supported by the path into said central zone.

* * * * *